United States Patent [19]

Laing et al.

[11] Patent Number: 5,072,717

[45] Date of Patent: Dec. 17, 1991

[54] HOT WATER PRIMING DEVICE

[76] Inventors: Doerte Laing, Hofenerweg 37, D 7148, Remseck-2, Fed. Rep. of Germany; Karsten Laing, 3970 Honeycutt St., San Diego, Calif. 92109; Ludwig Ludin, Kesselackerstrasse 23 CH, 5611 Anglikon, Switzerland

[21] Appl. No.: 575,985

[22] Filed: Aug. 31, 1990

Related U.S. Application Data

[63] Continuation-in-part of Ser. No. 510,034, Apr. 16, 1990, abandoned, and a continuation of Ser. No. 844,206, Mar. 26, 1986, abandoned.

[51] Int. Cl.[5] ..... F24D 17/00

[52] U.S. Cl. ..... 126/362; 126/350 D; 137/590

[58] Field of Search ..... 126/362, 350 D; 137/590; 237/19; 236/101 R

[56] References Cited

U.S. PATENT DOCUMENTS

| | | | |
|---|---|---|---|
| 2,967,666 | 1/1961 | Carlson | 126/362 X |
| 4,142,676 | 3/1979 | Hattori | 236/101 R |
| 4,208,994 | 6/1980 | Kitamura | 236/101 R |
| 4,680,446 | 7/1987 | Post | 126/362 X |
| 4,682,581 | 7/1987 | Laing et al. | 126/362 |
| 4,697,614 | 10/1987 | Powers et al. | 126/362 X |

*Primary Examiner*—Carl D. Price

*Attorney, Agent, or Firm*—Henri J. A. Charmasson

[57] ABSTRACT

In a hot water distribution system, a priming device installed just ahead of a tap stores a small amount of water and continuously maintains it to the temperature of the hot water source. When the tap is opened, the water from the priming device is first drawn while the cooled down water which was stationary in the pipe coming from the heating tank refills the priming device. When the pipe is cleared of cold water the priming device is bypassed, and its stored cold water is slowly admixed in the flow of hot water to the tap.

12 Claims, 3 Drawing Sheets

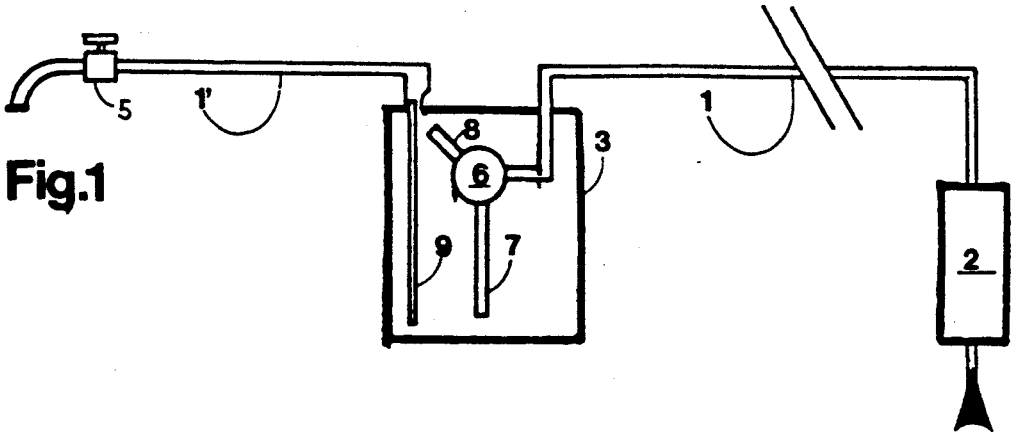
Fig.1
Fig.2
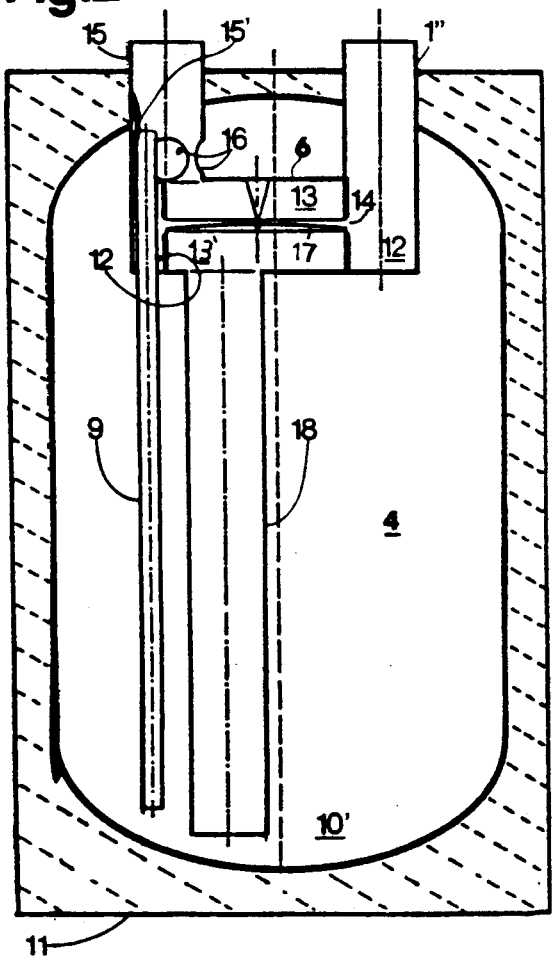
Fig.3
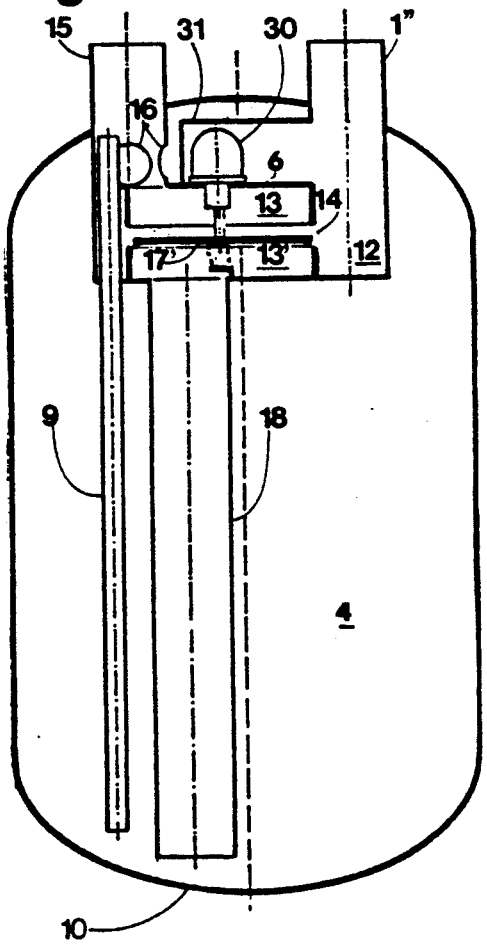

HOT WATER PRIMING DEVICE

PRIOR APPLICATIONS

This application is a continuation-in-part of co-pending application Ser. No. 07/510,034 filed Apr. 16, 1990, now abandoned, a continuation of Ser. No. 06/844,206 filed Mar. 26, 1986, abandoned.

BACKGROUND OF THE INVENTION

Secondary recirculation systems are commonly used to provide instant hot water to taps distal from their hot water source. In such a system, a pump continually recirculates the hot water through the distribution pipes. This system uses additional closed loop piping, and requires significant energy to replace the heat lost through the recirculation pipes.

SUMMARY OF THE INVENTION

The invention provides a reserve of hot water stored in a thermally insulated priming reservoir. This priming reservoir is located between the pipe of a hot water grid and a hot water tap or faucet. When the tap is opened, the cooled down water contained in the pipe is guided to the bottom of the priming reservoir, forcing the hot water in the reservoir toward the tap. As soon as hot water from the hot water supply reaches the priming reservoir, a thermal valve guides the source water directly to the tap bypassing the priming reservoir. In order to replace the cold water now stored in the reservoir, a small tube connects the bottom region of the reservoir to its outlet port. The outlet opening of this tube ends in an area where the water stream leaving the reservoir through the outlet port has a high velocity. The high velocity produces a Venturi suction relative to the pressure inside the reservoir. This suction causes an admixture of a small percentage of the cold water from the small tube to the hot water stream so that the cold water content leaves the reservoir and is automatically replaced by hot water. A more advanced solution uses a second bymetal snap disc to selectively admit water from the deepest point of the reservoir into a drain through which it is expelled. The expelled cold water is automatically replaced by additional water coming from the hot water supply.

A third solution uses a combination of both of the two aforementioned methods to replace the cold water in the reservoir with hot water.

The invention makes use of a new two-way valve with a bimetal snap disc or two wax elements. The further improvement makes use of a long channel extending from the lowest region to the upper region of the priming reservoir to prevent mixing between the hot and cold water.

BRIEF DESCRIPTION OF THE DRAWINGS

FIG. 1 is a diagram of a hot water distribution installation with a water heater, a hot priming device and a faucet;

FIG. 2 shows in cross-section the elements of the priming device and a two-way valve with bimetal snap disc;

FIG. 3 shows in cross-section the elements of a second embodiment of the priming device with a valve plate actuated by a wax element;

DESCRIPTION OF THE PREFERRED EMBODIMENTS OF THE INVENTION

Figure 4:
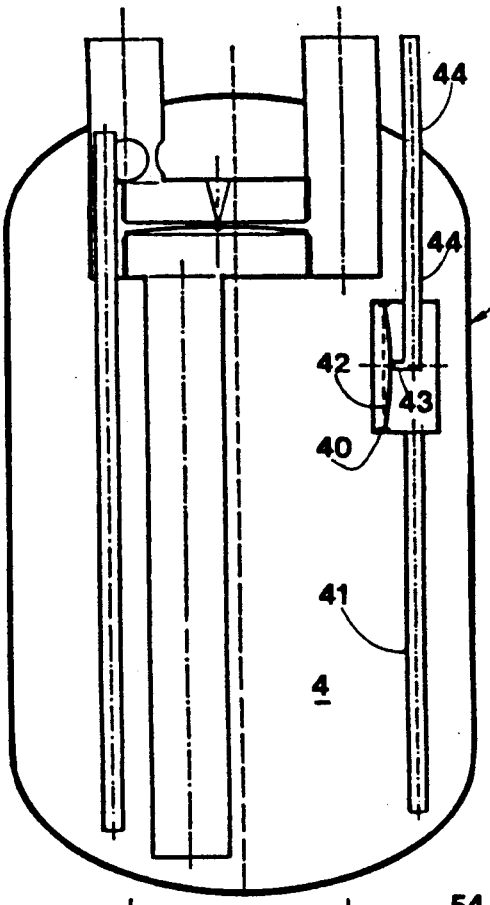
FIG. 4 shows in cross-section the elements of a third embodiment of the priming device having in addition to the features of FIG. 2, a thermally actuated valve to expel cold water.

FIG. 1 is a diagram of a hot water distribution circuit equipped with the priming device. The abbreviated representation of the hot water pipe 1 leads from the hot water supply tank 2 to the thermally insulated priming device 3. From the priming device 3, a short length of pipe 1' leads to the faucet 5. A thermal two-way valve 6 connects pipe 1 with conduit 7 leading to the bottom area of the insulated priming reservoir 4 as long as the incoming water remains cold. Since the capacity of the reservoir is substantially equal to the capacity of the incoming pipe 1, hot water begins to appear at the thermal valve 6 just about the time the reservoir 4 is filled with cold or lukewarm water drained from the pipe 1. As the water temperature reaches a predetermined value, the thermal valve 6 directs the incoming water toward pipe 1' and the tap 5. A tube 9 of a gauge substantially smaller than the outlet port connects the bottom region of the reservoir 4 with a narrowed area at the outlet port of the reservoir leading to pipe 1'. The Venturi effect at this narrowed area causes cold water collected in the reservoir to be admixed through the tube 9 to the hot water stream of the faucet 5, while hot water from the incoming pipe replaces said cold water.

FIG. 2 shows a cross-section of a first embodiment of the priming device 10. The reservoir 4, the height of which is larger than the diameter, is protected against heat loss by insulating jacket 11. The hot water distribution grid communicates via inlet port 1" with a thermal valve 6 consisting of an annular channel 12, a bimetal snap disc 17 and a chamber 13. The chamber 13 leads to an outlet port 15 which has openings 16 to the inside of the reservoir 4. The bimetal snap disc 17 is mounted in the middle plane of an annular gap 14 between the chambers 13 and 13'. If the tank 4 is filled with hot water, the bimetal snap disc acts as a valve element and allows the water coming from the inlet port 1" to leave the reservoir through outlet port 15.

If the water entering the inlet port 1" is cold, the bimetal snap disc 17 cambers into the position opposite the one illustrated, and guides the cold water through chamber 13' and downward tube 18 to the bottom region of the reservoir 4. The cold water having a slightly higher density pushes the hot water upwardly so that it leaves the reservoir through hole 16 and the outlet port 15. As soon as the water entering through the inlet port 1" reaches a predetermined water temperature, the bimetal snap disc 17 cambers into the position shown in the drawing and the hot water stream flows directly through the valve, bypassing the reservoir. The narrow region 15' of outlet port 15 communicates through tube 9 with the bottom region of the reservoir 4. In this narrow region 15 the acceleration of the water stream creates a slight Venturi action which causes an admixture of a few percent of cold water from the bottom region into the hot water flow. The evacuated cold water is automatically replaced by hot water entering the reservoir 4 through the hole 16, providing that the volume of cold or lukewarm water which is drained from the supply pipe does not exceed the capacity of the reservoir 4. After a short period, reservoir 4 is totally filled with hot water.

FIG. 3 shows a second embodiment of the priming device 19 where the bimetal disc of the first embodiment is replaced by a wax element 30. When heated up by the incoming water, the wax element moves the valve plate 17' so that the annular space 12 through the annular gap 14 communicates through chamber 13 with the outlet port 15. If the wax element 30 is cooled down by incoming cold water the valve plates 17' closes the chamber 13 and lets the incoming water flow through chambers 13 and tube 18 to the bottom region of the reservoir 4. The chamber 31 communicates with inlet port 1''. This chamber will be insulated so that the wax element 30 has the same temperature as the water in pipe 1''.

FIG. 4 shows a third embodiment 20 of the priming device in which an inner chamber 40 communicates through tube 41 with the bottom region of the reservoir 4. Inside the chamber 40 a bimetal snap disc 42 is mounted. The disc 42, in the position shown, closes the nozzle 43 of drain pipe 44. This pipe leads to the outside. The chamber 40 is positioned in the upper half of the reservoir 4.

If the temperature in the upper half of the reservoir 4 falls below a predetermined temperature, the bimetal snap disc 42 snaps into the opposite cambered position, and the pressurized cold water inside the reservoir will be expelled through nozzle 43 and drain pipe 44. The bimetal snap disc 42 remains in this position as long as cold water flows through the chamber 40; that is until the total content of cold water in the reservoir 4 and in pipe 1 of FIG. 1 has been expelled and hot water entering through the holes 16 has reached the bottom region of the reservoir 4.

The cold water expelled through drain pipe 44 flows into the building drain system. Preferably, pipe 44 leads to the spout of a faucet.

Figure 5:
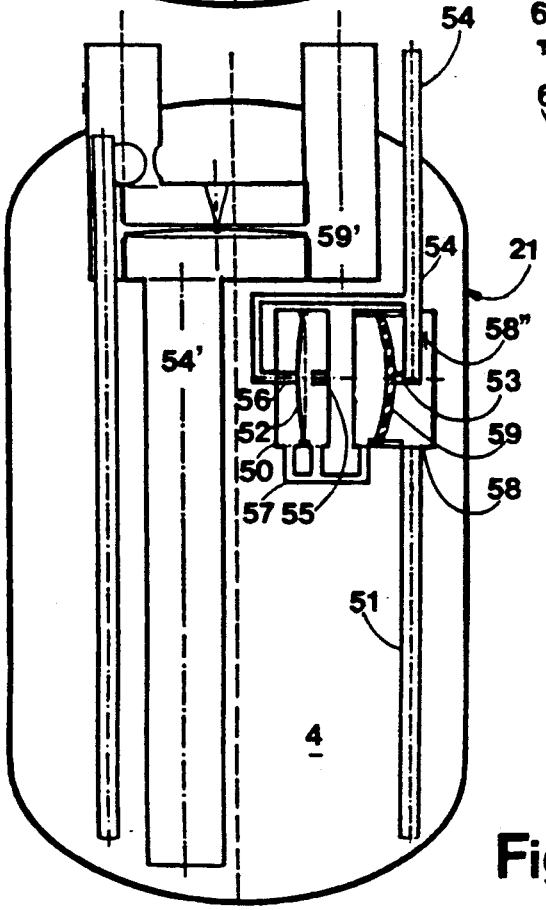
FIG. 5 shows in cross-section the elements of a fourth embodiment of a priming device having in addition to the features of FIG. 4, a valve to expell cold water with a temperature sensor.

FIG. 5 shows a fourth embodiment 21 of the priming device with a different water expelling system. A bimetal snap disc 52 is positioned in a first chamber 50 to alternately close two nozzles 55 and 56 disposed on opposite sides. The first chamber 50 communicates through a manifold 57 with a second chamber 58. This second chamber 58 is divided into left add right sections by a rubber diaphragm 59. The diaphragm acts as a valve for the nozzle 53 of a drain pipe 54. The drain pipe 54 leading to the outside has a branch 54' leading to the nozzle 56 inside the first chamber 50. Nozzle 55 communicates with the reservoir 4. The second chamber 58 communicates via tube 51 with the bottom region of the reservoir 4. As long as the temperature of the water in the reservoir 4 exceeds a predetermined temperature, the bimetal snap disc 52 is cambered in the position shown, thereby closing nozzle 56. A spring 59' in the left section of the second chamber presses the diaphragm 59 against nozzle 52. As soon as the temperature of the water in the upper half of the reservoir 4 falls below a predetermined temperature, the bimetal snap disc 52 cambers toward the right side, closing nozzle 55 and opening nozzle 56. Now the first chamber 50 is under ambient pressure and so is the right section of the second chamber 58. The water pressure in the right section of the second chamber 58 moves the rubber diaphragm 59 away from nozzle 53, and water from the bottom region of the reservoir 4 is expelled until the hot water reaches the bottom of the reservoir. In FIGS. 3, 4 and 5 the insulating jacket is not shown for sake of clarity.

Figure 7:
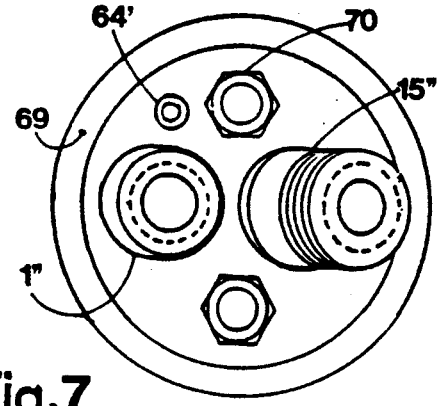
FIG. 7 is a top plan view thereof.
Figure 6:
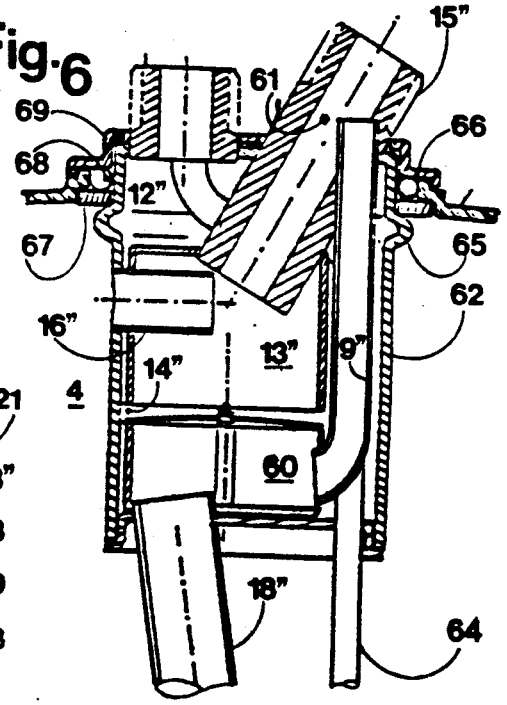
FIG. 6 shows in cross-section a two-way valve of the priming device.

In FIGS. 6 and 7, illustrating the input valve mechanism, only the upper section of the reservoir 4 is shown. The inlet port 1'' communicates with space 12'' and therefore with the annular gap 14''. Chamber 13'' has an opening 16'' to the inside of the reservoir and communicates with outlet port 15''. The small tube 9'' connects the lowest part of the reservoir via tube 18'' and chamber 60 to the narrow region 61 of the outlet port 15''. Tube 64 leads to a outlet 64' through which cold water is expelled by the water expelling unit of FIGS. 4 and 5.

The housing 62 shows a projecting ridge 65, the outer diameter of which is slightly smaller than the diameter of the hole 66 in the top of the reservoir 4. During the assembly, the whole two-way valve is inserted into the reservoir, thereafter a split ring 67 is brought into position and O-ring 68 is placed in the space between the shoulder of the hole 66 and the housing 62. A cover 69 is pressed against the O-ring 68 by screws 70.

Figure 8:
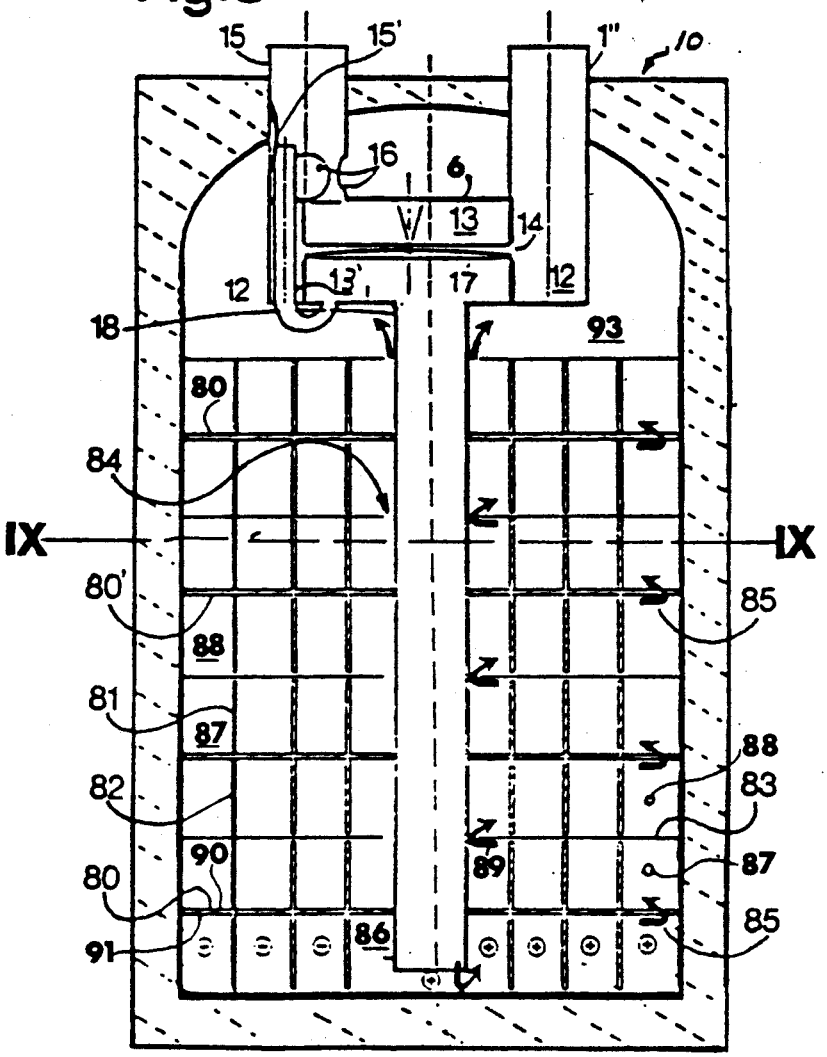
FIG. 8 is shown in cross-section of the elements of a priming device with a spiraling channel.
Figure 9:
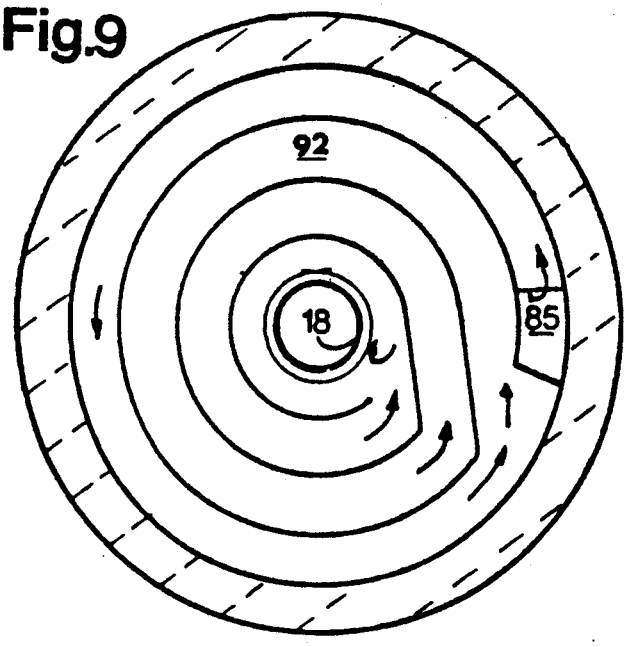
FIG. 9 is a cross-sectional view taken along line IX—IX of FIG. 8.

FIGS. 8 and 9 illustrate a further improvement to the priming device shown in FIG. 2, which could also be implemented in conjunction with the other embodiments of the invention described herein. The improvement is designed to prevent a too-rapid mixing of the entering stream of cold water drawn from the hot water source distribution pipes through inlet 1'' with the hot water stored in the reservoir. The improvement consists mainly in providing a longer tortuous path for the cold water exiting through the bottom of tube 18 as it moves toward the top section of the reservoir. The downflow tube 18 has been moved to an axially central position. The inside of the reservoir is divided by a series of discs 80 extending normally from the outer periphery of the tube 18 at regular intervals and into contact with the lateral wall of the reservoir. The reservoir is thus divided into horizontal layers. Passage of the water from one layer to the next upper layer is through a single hole 85 cut through the disc near its periphery. Each so-created layer is further divided at mid-height by a washer-like separator 83 which extend horizontally from the inner walls of the reservoir to the proximity of the tube 18 so that the water can move from the bottom half 87 of one of the layers to the upper half 88 through the annular space 89 between the inner edge of the separator 83 and the tube 18. Furthermore, the top surface 90 of each disc 80 supports a spiral fin 81 which extends upwardly to the adjacent separator 83. Similarly the bottom surface 81 of each disc 80 supports its spiral fin 82 which extends either to the bottom of the reservoir in connection with the lowest disc 80 or to the adjacent lower separator 83. It can now be understood that the cold water exiting from the tube 18 in the bottom area 86 of the reservoir must first follow the circuitous path through the spiral channel 92 indicated by the arrows in FIG. 9. As the cold water progresses from one half layer to the next, it follows the path indicated by the arrows in FIG. 8 alternating from the periphery of the reservoir to the area along the tube 18. The water exits the meandering structure just described in the central upper region 93 of the reservoir. This structure of staggered discs 80 and separators 83, and spiraled divider 82 assures that the cold water coming out of the bottom of the tube 18 slowly displaces the hot water stored in the reservoir rather than mixing indiscriminately with it.

While the preferred embodiments of the invention have been described, modifications can be made thereto and other embodiments may be devised without departing from the spirit of the invention and the scope of the appended claims.

What is claimed is:

1. In combination with a hot water distribution system wherein water from a hot water source is brought through a conduit to a hot water tap, a priming device which comprises:

a temporary storage reservoir having an inlet port and an outlet port in the upper region of the reservoir, and a capacity substantially commensurate with the capacity of said conduit;

said reservoir being placed in series with said conduit proximally to said tap;

means for continuously preventing heat loss through walls of said reservoir;

means for detecting the temperature of the water flowing through said inlet port;

means responsive to said means for detecting, for alternately directing water admitted through said inlet port toward an upper and a lower region of the reservoir; and means for evacuating water from a lower region of the reservoir, said means for evacuating comprising a channel having an intake port in a lower region of the reservoir, and a discharge port proximate said outlet port in the upper region of the reservoir.

2. The combination of claim 1, wherein said means for alternately directing comprises a first thermal valve.

3. The combination of claim 2, wherein said means for continuously maintaining comprises a thermally insulating jacket around said storage reservoir.

4. The combination of claim 3, wherein said means for detecting and said first thermal valve consist of a metal snap disc.

5. The combination of claim 3, wherein said means for alternately directing water comprises a tube for conducting water from said first thermal valve to said lower region of the reservoir.

6. The combination of claim 5, wherein said reservoir comprises a plurality of partitions shaped and dimensioned to create a narrow and circuitous path for water moving from said lower region to said upper region of the reservoir.

7. The combination of claim 6, wherein said partitions comprise a combination of horizontal separations dividing the reservoir into a series of superimposed compartments, and within each of said compartments a spiral septum for imposing multiple circular paths to the water within said compartments.

8. The combination of claim 7, wherein said tube is located in the axial center of the reservoir, and said partitions comprise alternately staggered disc-like fins extending from the outer periphery of said tube, and washer-like separators projecting from the inner wall of the reservoir.

9. The combination of claim 1, wherein said discharge port has a gauge substantially smaller than said outlet port.

10. The combination of claim 1, which further comprises a second channel having an intake port in a lower region of the reservoir, a discharge port outside said reservoir, and a second thermal valve within said channel.

11. The combination of claim 10, wherein said second thermal valve is located in an upper region of the reservoir.

12. The combination of claim 11, wherein said second thermal valve comprises a bimetal snap disc.

* * * * *